US005335149A

United States Patent [19]

Evans

[11] Patent Number: 5,335,149

[45] Date of Patent: Aug. 2, 1994

[54] METHOD AND APPARATUS FOR HOLDING A LIGHT ON A BOAT

[75] Inventor: Kenneth W. Evans, Penticton, Canada

[73] Assignee: Sierra Sun Holdings Ltd., Penticton, Canada

[21] Appl. No.: 882,527

[22] Filed: May 13, 1992

[51] Int. Cl.[5] ..... B63B 45/00

[52] U.S. Cl. ..... 362/61; 362/109; 362/396; 362/399; 362/431; 43/17.5

[58] Field of Search ..... 362/61, 109, 389, 396, 362/399, 426, 431, 120, 80; 43/17, 21.2, 17.5

[56] References Cited

U.S. PATENT DOCUMENTS

| | | | |
|---|---|---|---|
| 2,603,900 | 7/1952 | Kellett | 43/17 |
| 3,064,122 | 11/1962 | Reeder, Jr. | 240/7.5 |
| 3,502,861 | 3/1970 | Evans | 43/17.5 X |
| 3,546,805 | 12/1970 | Schaeffer | 43/17 |
| 3,667,708 | 6/1972 | Smeltzer | 248/39 |
| 3,851,166 | 11/1974 | Kohler | 240/57 |
| 4,471,554 | 9/1984 | Heiskell | 43/17 |
| 4,587,603 | 5/1986 | Hughes | 362/396 X |
| 4,709,890 | 12/1987 | Moore | 362/396 X |
| 4,827,389 | 5/1989 | Crum | 362/388 |
| 4,856,452 | 8/1989 | Pingel | 114/364 |
| 4,884,173 | 11/1989 | Cassidy | 362/61 |
| 5,088,224 | 2/1992 | Gutierrez | 43/17 X |

OTHER PUBLICATIONS

Page 10 of Scotty Sportfishing Products 1989 (Scotty Marine & Fishing Products, 21 Erie St., Victoria, B.C. Canada V8V 1P8).

*Primary Examiner*—Stephen F. Husar
*Attorney, Agent, or Firm*—Bull, Housser & Tupper

[57] ABSTRACT

A utility light apparatus comprising a body having a distal end portion and a proximal end portion. A light is secured to the distal end portion, the light being operable to emit a light beam. A holder, which may include a fishing rod holder, is secured to a boat or other object, the holder having a receptacle. The proximal end portion of the body has a connecting portion of sufficient size to permit the connecting portion to be received and releasably held in the receptacle.

21 Claims, 3 Drawing Sheets

METHOD AND APPARATUS FOR HOLDING A LIGHT ON A BOAT

BACKGROUND OF THE INVENTION

This invention relates to a utility light apparatus for general use and, more particularly, relates to a utility light apparatus and light holder for a boat.

Boating has many forms including pleasure boating and the use of boats for work. Whatever the form of boating, a mariner may find himself in adverse lighting conditions such as at pre-dawn, dusk, night or during severely overcast periods. It is common to employ some form of lighting to improve visibility in such conditions.

Conventional lighting methods include hull or deck mounted spotlights, ideally suited for observing objects ahead of the boat, or handheld spotlights which permit a light beam to be directed in any direction. Handheld spotlights require a crew member or even the skipper to hold the spotlight in one hand while attempting to perform other duties such as fishing, hauling nets, or even steering the boat. Holding a spotlight in one hand while performing these duties limits the ability of the crew member or skipper to direct his full attention to the other duties which might be required at the time lighting is required. Thus it is preferable to have a mounted light to free-up the crew member or skipper.

Mounted lights are usually mounted near the bow of the boat and thus are particularly well adapted to observe objects ahead of the boat. However, their ability to illuminate objects abeam or aft is often limited due to other appurtenances mounted on the boat, which may obscure the light beam in certain positions. Furthermore, a light mounted near the bow of a relatively small pleasure boat is usually out of reach of the crew and skipper and therefore directional control of the light beam is not possible or can only be done using expensive remote control apparatus. It would be preferable to have a light mounted on an accessible portion of the gunwales of the boat, in an accessible position such as the position in which fishing rod holders are conventionally mounted. This would enable a crew member or, in some cases, even the skipper to control the direction of the light beam.

The present invention permits a lighting apparatus to be mounted in an accessible position on a relatively small pleasure boat and thus permits a crew member or the skipper to control the direction of the light beam. This enables the operator in control of the light beam to direct the beam forward, aft or abeam of the boat without requiring hand-held operation of the apparatus.

SUMMARY OF THE INVENTION

In accordance with the present invention there is provided a utility light apparatus comprising a body having a distal end portion and a proximal end portion. A light is secured to the distal end portion, the light being operable to emit a light beam. A holder, which may include a fishing rod holder, is secured to a boat or other object, the holder having a receptacle. The proximal end portion of the body has a connecting portion of sufficient size to permit the connecting portion to be received and releasably held in the receptacle.

Preferably, the connecting portion includes at least one resiliently deformable member which is resiliently deformed when the connecting portion is inserted in to the receptacle to tightly hold the connecting portion in the receptacle with sufficient force to prevent substantial movement of the connecting portion therein during normal use of the apparatus.

Also preferably, the apparatus includes securing means for securing the light to the distal end portion, the securing means including a swivel connector between the light and the distal end portion, the swivel connector permitting movement of the light relative to the distal end portion about at least two axes to permit the light to be positioned such that the beam may be directed away from objects near the light to avoid obscuring the view of objects upon which the beam is focused such as may occur due to reflection of the beam off the boat's hull.

Preferably the apparatus further includes a watertight cover extending between the light and the distal end portion and includes electrical wires for supplying electrical power to the light, the electrical wires being located inside the watertight cover. The watertight cover preventing water from reaching the swivel connector and from contacting the electrical wires leading into the light.

Also preferably, the light has lens connecting means for permitting the connection of a lens, such as a fog lens, to the light.

DETAILED DESCRIPTION

Fishing Rod Holder

Figure 1:
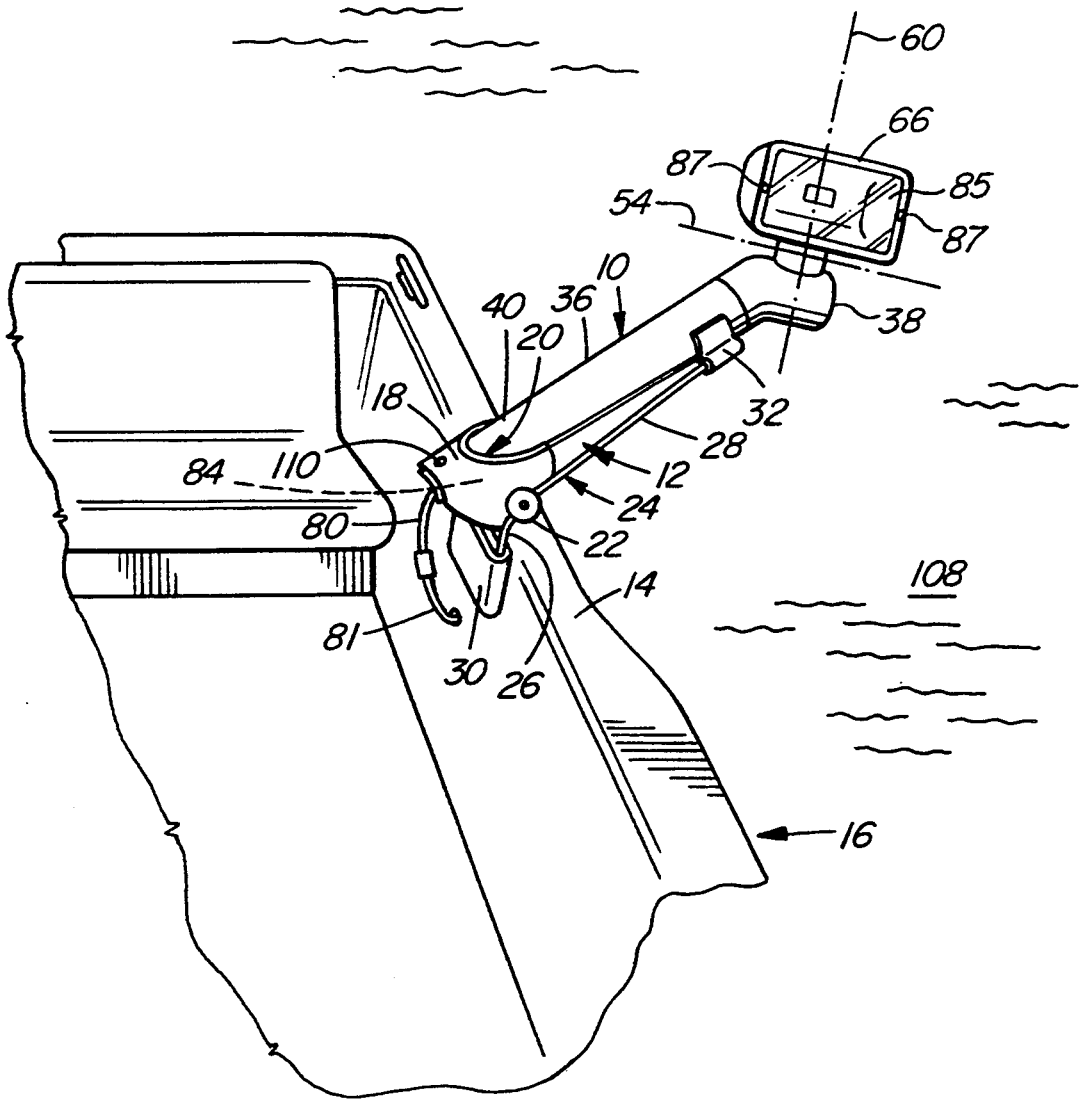
FIG. 1 is an aft perspective view of a utility light apparatus according to a first embodiment of the invention, the apparatus being installed in a conventional fishing rod holder mounted on a gunwale of a boat.

Referring to FIG. 1 a utility light apparatus according to a first embodiment of the invention is shown generally at 10 installed in a conventional fishing rod holder mounted on a gunwale 14 of a boat 16. For explanatory purposes, the fishing rod holder 12 has a body 18 having a receptacle 20, normally used to receive and hold a butt-end of a fishing rod. The body has an adjustable friction connector 22 which connects it to a wire frame 24 having a mounting portion 26 and a support portion 28. The mounting portion 26 is received in a rod-holder mount 30 securely fastened to the gunwale 14. The support portion 28 projects away from the body 18 and is terminated with a support cradle 32 normally used to support a portion of a fishing rod. It will be appreciated that the fishing rod holder 12 is securely held on the gunwale of the boat and thus provides a secure holding apparatus for the utility light apparatus 10.

Utility Light Apparatus

Figure 2:
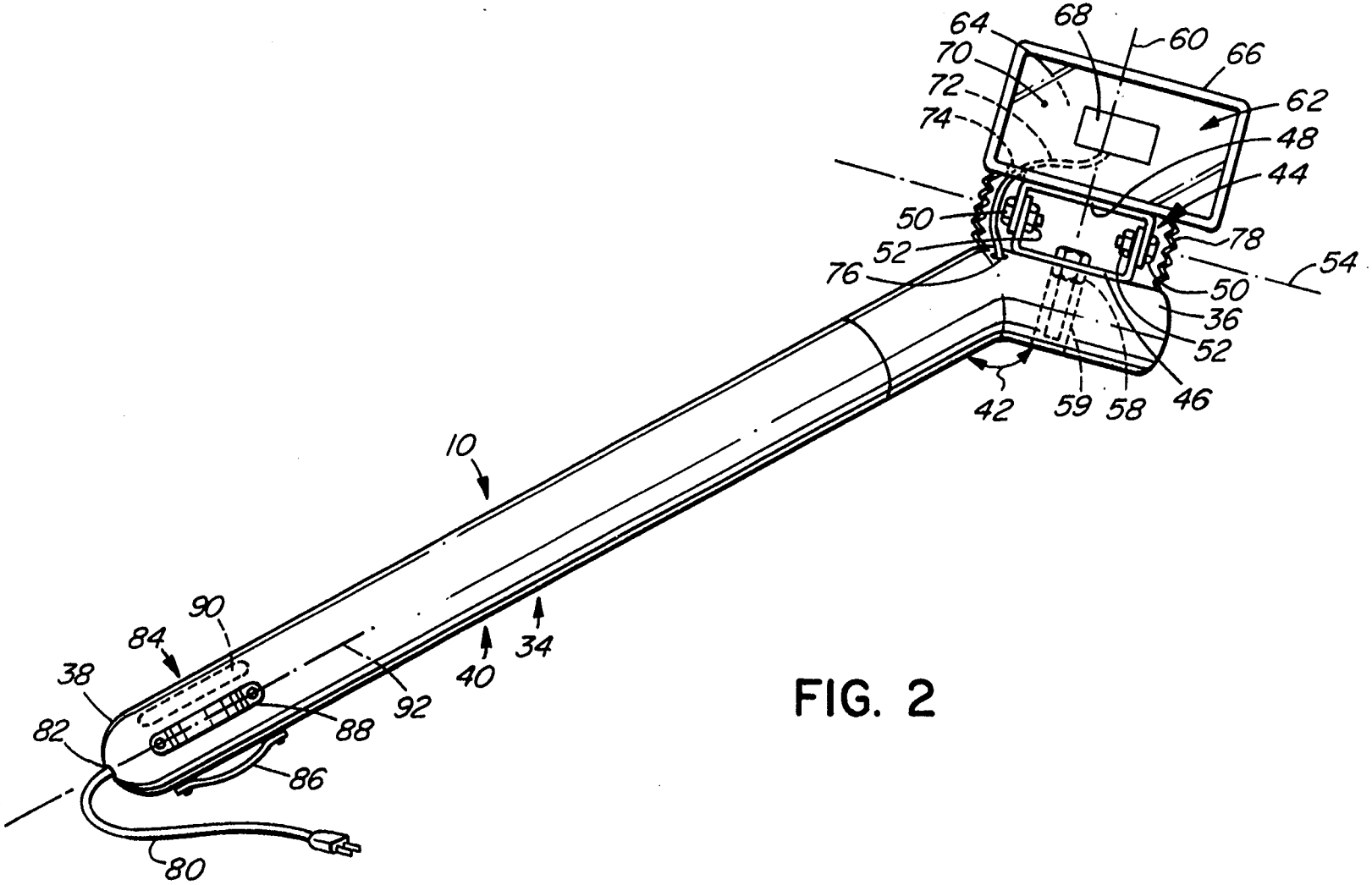
FIG. 2 is a front view of the utility light apparatus shown in FIG. 1.

Referring to FIG. 2, the utility light apparatus 10 includes a circular cross-sectioned tubular body 34 having a distal end portion 36, a proximal end portion 38 and a mid portion 40 extending between the distal and proximal end portions. The distal end portion 36 extends at an angle 42 relative to the midportion 40. The angle 42 is preferably between 120 degrees and 150 degrees and is optimally 135 degrees. The proximal end portion 38 is preferably parallel and in axial alignment with the mid portion 40.

To the distal end portion 36 is connected a swivel connector shown generally at 44. The swivel connector includes a base portion 46 and a mounting portion 48 which are pivotally connected together by screws and nuts 50 and 52 which permit pivotal movement of the mounting portion relative to the base portion about a first axis 54. The base portion 46 is connected to the distal end portion 38 by a bolt and nut 56 and 58 respectively such that the base portion 46 is permitted to pivot about a second axis 60 extending perpendicularly through the distal end portion.

The nut 58 is glued inside a bushing 59 having a length approximately equal to the inside diameter of the distal end portion 36. End portions of the bushing are shaped complementary to the inside surface of the distal end portion 36 such that the end portions have a relatively large surface area in contact with the inside surface of the distal end portion. An adhesive is applied between these relatively large surface areas and the inside surface such that the bushing is securely affixed to the distal end portion. This eliminates the use of a wrench to hold the nut 58 during tightening of the bolt 56, which would be a difficult task given the curvature of the inside surface of the distal end portion.

The mounting portion 48 is securely connected to a light 62 having a reflector 64, a reflector hood 66 and a light bulb 68. The reflector hood 66 is fastened to the mounting portion 48 and thus by applying a torque (with an operator's hand), to the reflector hood, the hood can be rotated about the first and second axes 54 and 60 to orient the hood in any desired position. The reflector is a standard rectangular parabolic reflector having a longitudinal axis and a horizontal axis. Preferably the angle between the distal end portion 36 and the mid-portion 40 is such that the longitudinal axis of the light is generally parallel with the water in which the boat is floating, when the apparatus is in use. In most applications the angle will be about 135 degrees.

The position of the reflector hood determines the direction of the beam of light reflected by the reflector. With the rectangular reflector described above the beam is unidirectional which is optimal for spotlight applications. A conventional round floodlight would also work, however, this could result in excessive reflection off the boat's hull.

A conventional clear window 70 is mounted on the reflector hood to protect the light bulb 68. The light bulb 68 is mounted in a conventional socket (not shown), to which power supply wires 72 are connected to supply electrical power to the light bulb. The electrical wires extend from inside the reflector hood 66 through an opening 74 therein and pass adjacent the swivel connector 44 into an opening 76 in the distal end portion 36. A rubber, watertight cover 78 extends about the swivel connector and electrical supply wires to cover and protect these items from water spray and rain. The electrical supply wires extend inside the tubular body 34, to the proximal end portion 38 where a connecting portion 80 of the wires exits the body through an opening 82. The wires are thus covered and protected over their entire length, with the exception of the connecting portion, and are therefore protected from water spray and rainwater.

Figure 3:
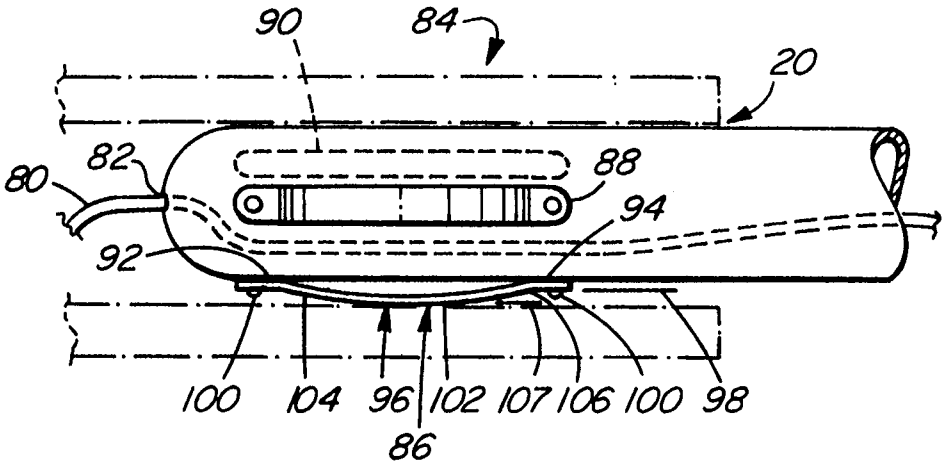
FIG. 3 is a fragmented side view of a connecting portion of the embodiment shown in FIG. 1.

The proximal end portion 38 of the body includes a connecting portion, shown generally at 84, which has first, second and third elongated resiliently deformable members 86, 88, and 90 connected thereto, in parallel with the longitudinal axis 92 of the connecting portion 40 and spaced apart angularly around the body. Referring to FIG. 3, first member 86 is representative of each of the resiliently deformable members and therefore only member 86 will be described, it being understood that the remaining members are similar.

Member 86 has first and second end portions 92 and 94 and a mid portion 96. The first and second end portions lie in a first common plane 98 and have respective openings therein (not shown) which are used to secure the member to the connecting portion 84 by means of rivets 100 extending through the openings. The mid portion 96 includes a central portion 102 and first and second transition portions 104 and 106 which project in a direction having a component in a radial direction relative to the connecting portion 84 such that the central portion 102 lies in a second plane 107 parallel to and spaced apart outwardly from the first plane 98. Thus, the central portions of respective resiliently deformable members are spaced apart from immediately adjacent portions of the connecting portion 84.

Operation

Referring to FIG. 1, the connecting portion 84 of the proximal end portion 38 of the apparatus 10 is inserted into the receptacle 20 of the fishing rod holder 12 secured to the boat 16. Referring to FIG. 3, as the connecting portion is inserted, the central portions 102 of the resiliently deformable members 86, 88 and 90 are deflected radially inwardly, toward the immediately adjacent body portions of the connecting portion 84. The resilience of the members and more particularly, the resilience of the transition portions 104 and 106 forces the central portions 102 radially outwardly, against the walls of the receptacle 20. Referring back to FIG. 1, this provides a tight, friction fit of the connecting portion 84 in the rod holder. This friction fit prevents both rotational and axial movement of the connecting portion relative to the rod holder. The resiliently deformable members thus tightly hold the connecting portion in the receptacle with sufficient force to prevent substantial movement of the connecting portion during normal use of the apparatus.

With the connecting portion 84 in the receptacle 20, a portion of the mid portion 40 of the body 36 rests in the saddle portion 32 of the rod holder. A rod holder of the type described typically can be adjusted such that the saddle portion is placed slightly higher than the receptacle. Thus, the lighting apparatus 10 can be held inclined upwards, with the distal end portion 36 higher than the proximal end portion 40 and preferably is adjusted such that the body projects generally upward and abeam of the boat to space the lamp apart from the gunwale of the boat to reduce reflection of the light beam off of the hull of the boat.

Referring to FIGS. 1 and 2, the angle 42 between the distal end portion 38 and the mid portion 36 is preferably chosen within the above mentioned range such that the distal end portion is approximately parallel with the surface 108 of the water in which the boat is floating as shown in FIG. 1.

With the apparatus in union with the fishing rod holder, the connecting portion 80 of the connecting wires is connected to a supply lead 81 in electrical connection with a power supply (not shown). Upon making this connection, power is supplied to the light bulb 68 and a light beam is produced.

With the distal end portion angled as described, the reflector hood 66 may be grasped by an operator of the apparatus and rotated about the first and second axes 54 and 60 which will be generally parallel to and perpendicular respectively to the surface 108 of the water. Thus, the beam produced by the apparatus can be directed along any path fore, aft, and abeam of the boat and up or down relative to the boat. Furthermore, as the apparatus is held in place by a rod holder, the apparatus is kept outside of the boat where it does not interfere with work which may be performed inside the boat. The apparatus can also be removed from the boat quickly and easily simply by performing the above steps in the reverse order. With the apparatus removed from the rod holder, the tubular mid-portion makes a comfortable hand grip for handheld use of the apparatus.

Alternatives

Referring to FIG. 1, a removable screw fastener 110 extending radially through the connecting portion and through a portion of the receptacle may be used to secure the connecting portion 84 of the apparatus to the fishing rod holder 12.

Referring back to FIG. 1, the reflector hood may be fitted with a coloured fog lens 85. Such a lens may be connected to the reflector hood with screws 87.

Figure 4:
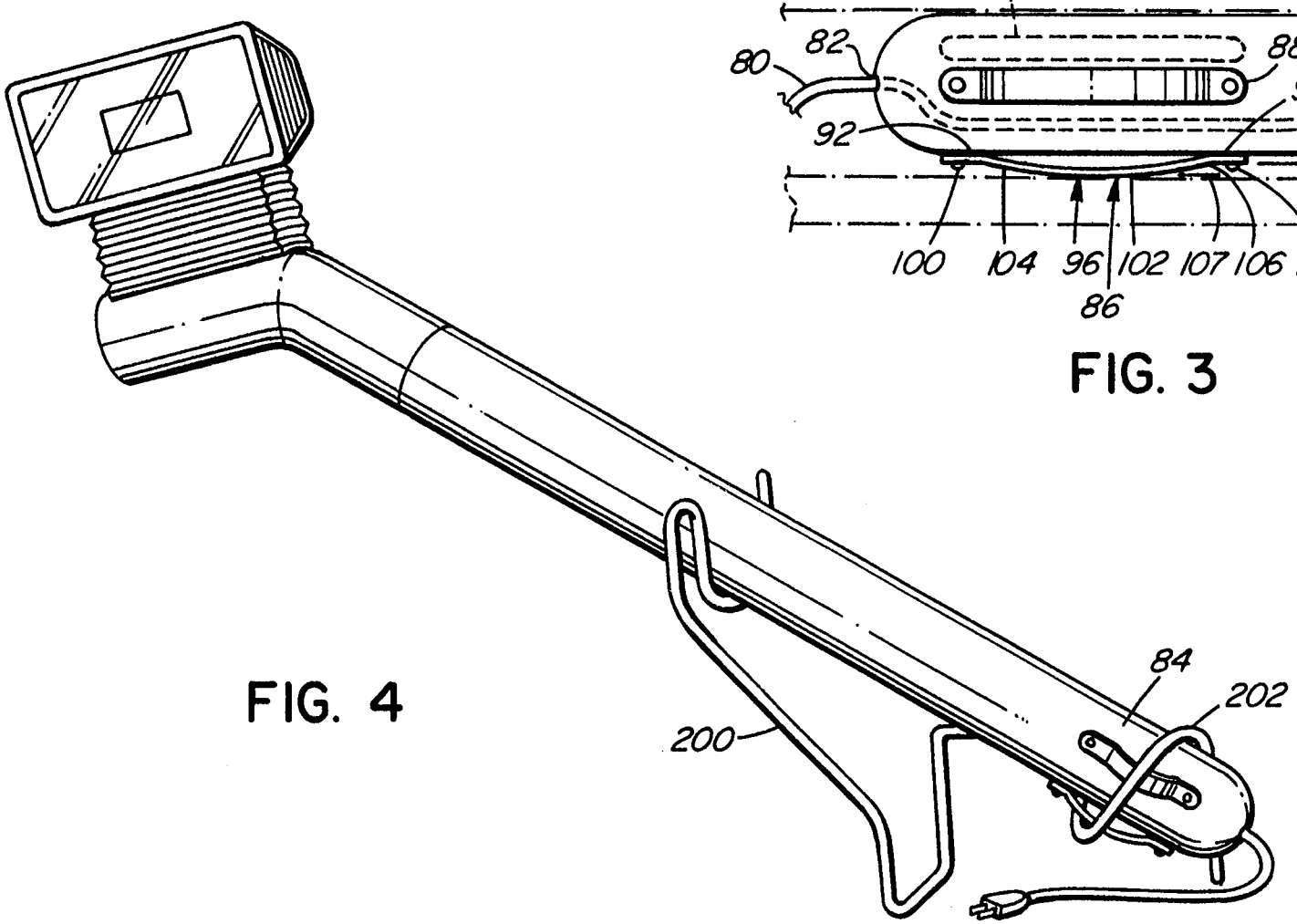
FIG. 4 is a simplified perspective view of the apparatus shown in use with a twisted-wire type rod holder.

Referring to FIG. 4, the apparatus may optionally be used with a twisted-wire fishing rod holder as shown generally at 200. This type of holder has a helical wire-wrap receptacle 202 which receives the connecting portion 84 of the apparatus. When the apparatus is used with this type of holder, it is preferable to ensure that the length of the first , second and third resiliently deformable members 86, 88 and 90 have a length at least as long as the pitch of the helical wire wrap to ensure that each of the resiliently deformable members contacts the wrap.

It will be appreciated that the light holder according to the invention is particularly useful when used in conjunction with a conventional fishing rod holder. The light holder is compact and conveniently used on a boat and permits smaller craft, not conventionally outfitted with a spotlight, to enjoy the benefits of a spotlight without requiring mounting holes in the hull or deck areas of the craft.

While embodiments of the invention have been described and illustrated, such embodiments should be considered illustrative of the invention only and not as limiting the invention as construed in accordance with the accompanying claims.

What is claimed is:

1. A utility light apparatus for a boat, the apparatus comprising:

a) a body having a distal end portion and a proximal end portion;

b) holding means for holding the body on the boat, the holding means including a fishing rod holder having a receptacle, said fishing rod holder being securable to the boat;

c) releasable connecting means on the proximal end portion of the body for releasably connecting the body to the holding means, the connecting means including a connecting portion of sufficient size to permit said connecting portion to be received and releasably held in the receptacle of the holding means; and d) a light secured to the distal end portion of the body, the light being operable to emit a light beam.

2. An apparatus as claimed in claim 1 wherein the holding means includes a support spaced apart from the receptacle, for supporting a portion of the body.

3. An apparatus as claimed in claim 1 wherein the body has a mid portion extending between the distal end portion and the proximal end portion and wherein the distal end portion extends at an angle relative to the mid portion.

4. An apparatus as claimed in claim 3 wherein the light has a rectangular shape having a longitudinal axis and a transverse axis, the angle between the distal end portion and the mid-portion being such that the longitudinal axis of the light is generally parallel with the water in which the boat is floating, when the apparatus is in use.

5. An apparatus as claimed in claim 1 wherein the light has a unidirectional beam.

6. An apparatus as claimed in claim 1 wherein the light has lens connecting means for permitting the connection of a lens to the light, the beam passing through the lens.

7. A method of holding a light on a boat, the method comprising the steps of:

a) inserting a proximal end portion of a tubular body to which the light is fastened, into a fishing rod holder secured to the boat; and b) connecting wires, in electrical communication with the light, to a power supply for supplying power to the light.

8. A method as claimed in claim 7 further including the step of resiliently deforming at least one resiliently deformable member secured to the proximal end portion during insertion of the proximal end portion into the fishing rod holder and using the resilience of said at least one resiliently deformable member to tightly hold the proximal end portion in the fishing rod holder.

9. A method as claimed in claim 7 further including the step of fastening a screw radially through the body and the fishing rod holder to secure the body in the fishing rod holder.

10. A method as claimed in claim 7 further including the step of adjusting the angle of the fishing rod holder relative to the boat such that the body projects generally abeam of the boat to space the light apart from the gunwale of the boat to reduce reflection of the beam of the light off of the hull of the boat.

11. A utility light apparatus comprising:

a) a generally sealed tubular body having a distal end portion, a proximal end portion and a mid-portion between the proximal end portion and the distal end portion, the distal end portion extending at an angle relative to the mid-portion;

b) a fishing rod holder for holding the body in position onto, and relative to a boat, the holding means including a receptacle for receiving the proximal end portion;

c) releasable connecting means on the proximal end portion for releasably connecting the proximal end portion to the receptacle, the connecting means including a connecting portion of sufficient size to permit said connecting portion to be received and releasably held in the receptacle and a resiliently deformable member on the connecting portion for providing a radially outward force against the receptacle to secure the connecting portion in the receptacle; and d) a light secured to the distal end portion of the body, the light being operable to emit a light beam.

12. A mounting apparatus for mounting a utility light on a boat, the apparatus comprising:

a) a generally hollow tubular body having a distal end portion, a proximal end portion and a mid portion extending between the distal and proximal end portions, the distal end portion extending at an angle to the mid portion, the utility light being connectable to the distal end portion;

b) releasable connecting means on the proximal end portion for connecting the body to a holder connected to the boat, the holder having a receptacle, the connecting means including a connecting portion of sufficient size to permit said connecting portion to be received and releasably held in the receptacle while preventing rotational and axial movement of the body relative to the receptacle.

13. An apparatus as claimed in claim 12 wherein the connecting means includes at least one resiliently deformable member which is resiliently deformed when the connecting portion is inserted into the receptacle, the member being operable to tightly hold the connecting portion in the receptacle with sufficient force to prevent substantial movement of the connecting portion during normal use of the apparatus.

14. An apparatus as claimed in claim 13 wherein said at least one resiliently deformable member is secured to the connecting portion and wherein the member has an extending portion extending radially outwardly from the connecting portion.

15. An apparatus as claimed in claim 12 wherein the connecting means includes a removable screw fastener extending radially through the connecting portion and through a portion of the receptacle.

16. An apparatus as claimed in claim 12 further including electrical wires for supplying electrical power to the light, and securing means for securing the light to the distal end portion, the securing means including a swivel connector between the light and the distal end portion, the swivel connector permitting movement of the light relative to the distal end portion about at least two axes to permit the light to be positioned such that the beam may be directed away from objects near the light to avoid obscuring the view of objects upon which the beam is focused.

17. An apparatus as claimed in claim 16 further including a watertight cover extending between said light and said distal end portion, the watertight cover preventing water from reaching the swivel connector.

18. An apparatus as claimed in claim 17 wherein the body includes a length of tubing, the electrical wires being routed inside the tubing and said watertight cover to prevent water spray from contacting the electrical wires.

19. An apparatus as claimed in claim 12 wherein the angle between the distal end portion and the mid portion is fixed and is between 122 degrees and 150 degrees.

20. An apparatus as claimed in claim 19 wherein the angle is 135 degrees.

21. An apparatus as claimed in claim 12 wherein the angle between the distal end portion and the mid portion is adjustable.

* * * * *